US005528883A

United States Patent [19]

Jamison

[11] Patent Number: 5,528,883

[45] Date of Patent: Jun. 25, 1996

[54] HIGH SPEED MODULAR FILM PRE-FORMING, FILLING AND PACKAGING APPARATUS AND METHOD

[76] Inventor: Mark D. Jamison, 3333 Sharun Pl., Zion, Ill. 60099

[21] Appl. No.: 338,949

[22] Filed: Nov. 14, 1994

[51] Int. Cl.[6] ..... B65B 5/10; B65B 35/54; B65B 43/04

[52] U.S. Cl. ..... 53/562; 53/202; 53/244; 53/251

[58] Field of Search ..... 53/562, 571, 573, 53/244, 240, 237, 455, 133.1, 410, 251, 250, 249, 202

[56] References Cited

U.S. PATENT DOCUMENTS

| | | | |
|---|---|---|---|
| 3,311,287 | 3/1967 | Long et al. | 229/53 |
| 3,380,646 | 4/1968 | Doyen et al. | 229/57 |
| 4,676,050 | 6/1987 | Odenthal | 53/244 X |
| 4,696,146 | 9/1987 | Esch et al. | 53/202 X |
| 4,733,517 | 3/1988 | Araki | 53/202 X |
| 4,793,121 | 12/1988 | Jamison | 53/410 |
| 4,897,858 | 1/1990 | Rieben et al. | 53/244 X |
| 5,155,967 | 10/1992 | Branson | 53/244 X |
| 5,328,319 | 7/1994 | Fadaie | 53/237 X |

*Primary Examiner*—James F. Coan
*Attorney, Agent, or Firm*—Ladas & Parry

[57] ABSTRACT

The present invention provides a system for the manufacturing of pouches. The system includes a pouch dispensing module, robotics module, filling and sealing module and a cartoning module. The robotics system is coupled with the other modules and loads containers with pouches for delivery to the filling and sealing module. The robotics module increases production and decreases costs of manufacturing the pouches.

20 Claims, 2 Drawing Sheets

HIGH SPEED MODULAR FILM PRE-FORMING, FILLING AND PACKAGING APPARATUS AND METHOD

TECHNICAL FIELD

The present invention relates to the manufacturing of flexible pouches, and more particularly to a system for forming, filling and sealing pouches of polymeric material.

BACKGROUND ART

There are prior art systems for forming a pouch. U.S. Pat. No. 3,380,646 discloses a method for forming a containing of plastic material. Reels of strips of plastic material are arranged for the forming, sealing and cutting of pouches.

There are also prior art systems for filling and sealing pouches. U.S. Pat. No. 3,311,287 discloses a conveyer belt system wherein pouches are fed to the conveyer belt, subsequently filled and sealed. The sealed pouches are then transferred to another conveyer belt for packaging, storage and shipping.

The prior art systems are slow, inefficient and require a substantial amount of manpower for operating.

SUMMARY OF THE INVENTION

In accordance with the present invention, a system is provided which avoids the prior art problem.

It is an object of the present invention to provide a system having a pouch feeder module which increases the production cycle.

It is a further object of the present invention to provide the above system which decreases production costs.

It is yet another object of the present invention to provide a system which reduces the amount of wasted pouches during the manufacturing thereof.

It is a further object of the present invention to provide a system having a filling and sealing module which increases the production cycle.

It is a further object of the present invention to provide a system having a filling and sealing module which decreases the cost of manufacturing the pouches.

In another embodiment of the invention, the system manufactures pouches that have a pre-formed spout prior to being filled.

DETAILED DESCRIPTION OF PREFERRED EMBODIMENT

Figure 1:
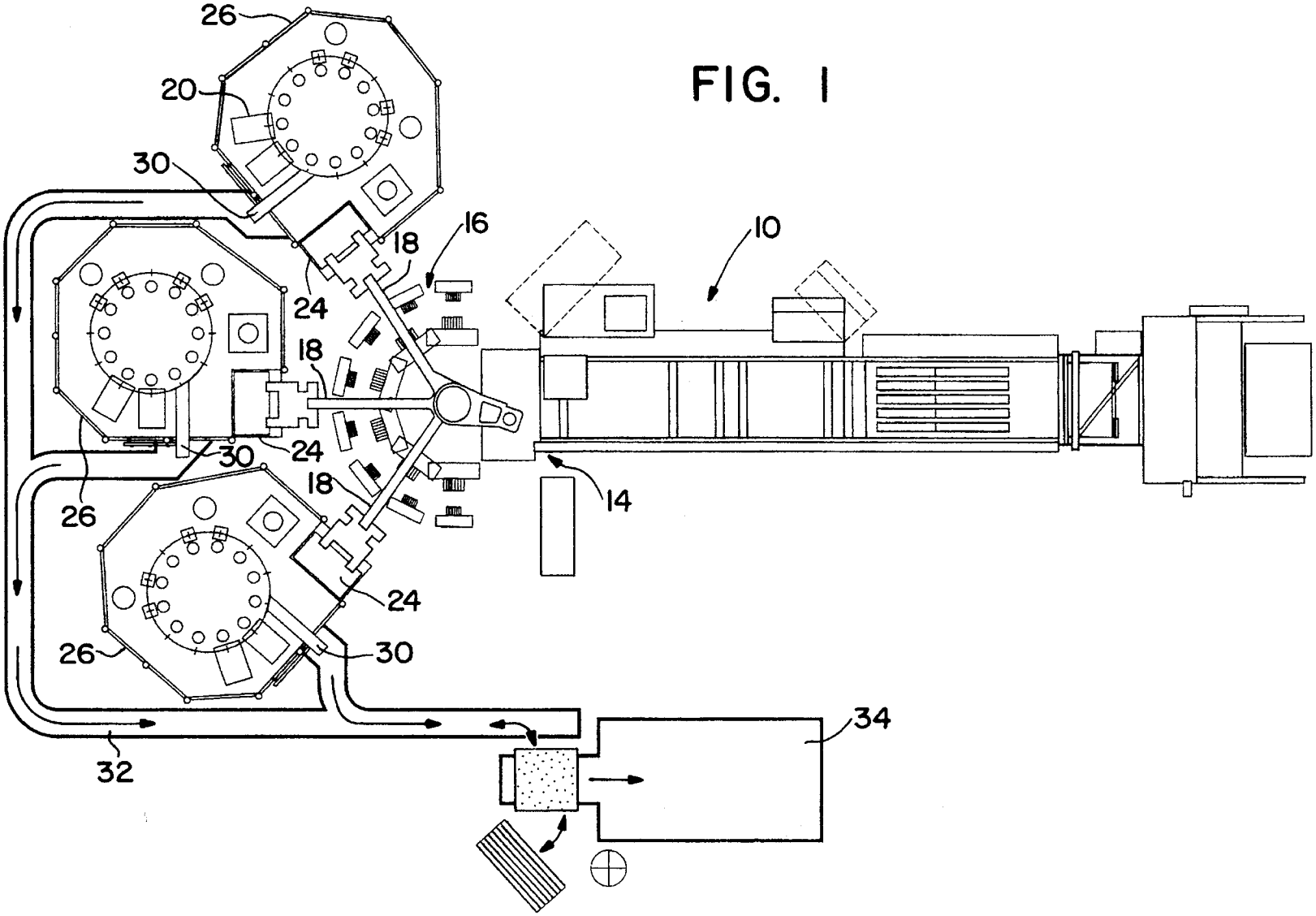
FIG. 1 is a graphical depiction of the system in a single location arrangement.

FIG. 1 discloses a pouch feeder module 10 which may provide premade pouches at its output or may comprise an actual pouch maker which manufactures the pouches from rolls of polymeric material as is known in the prior art. In addition, the pouch feeder module 10 may provide or produce pouches which have a pre-formed spout.

Figure 2:
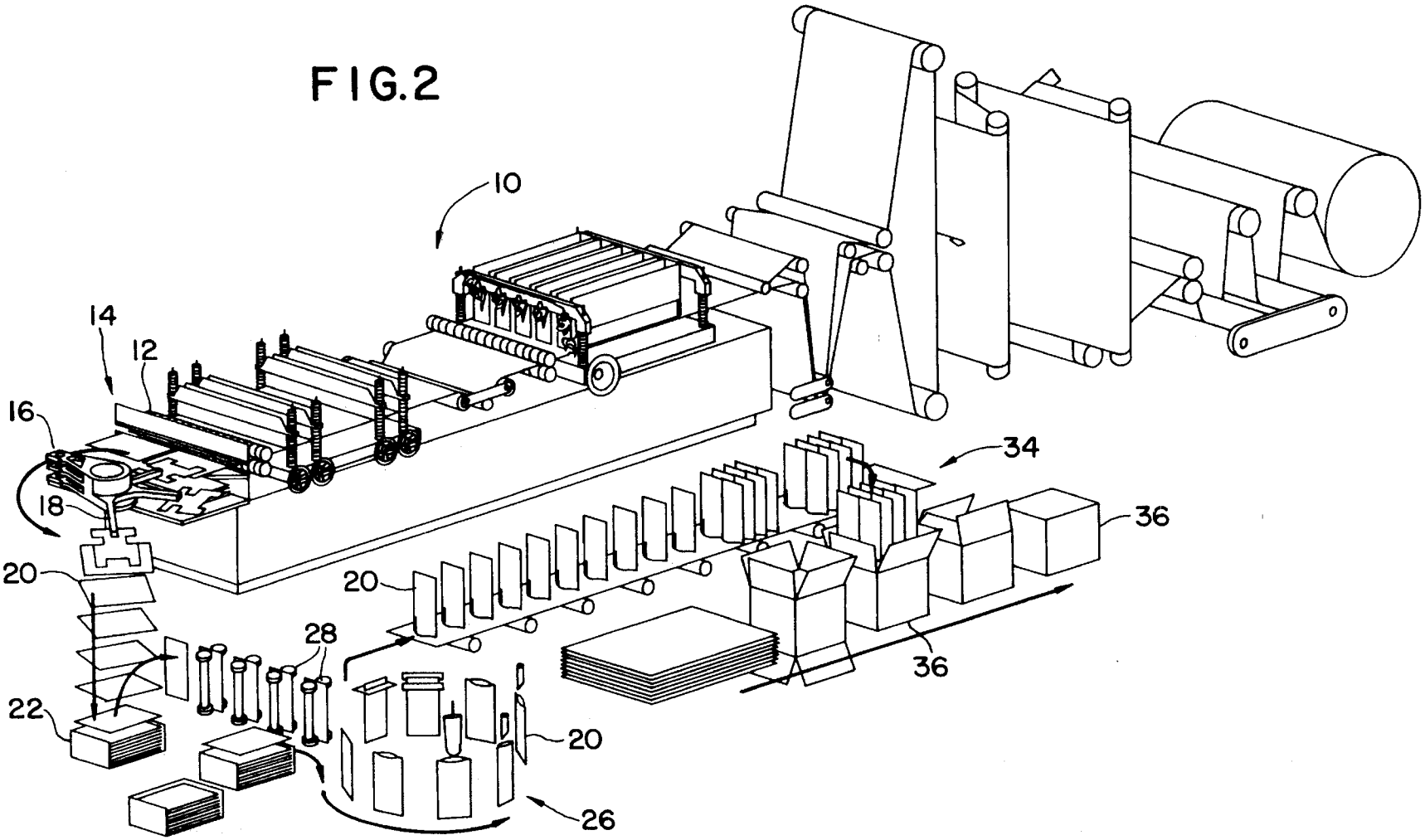
FIG. 2 is a graphical depiction of the system in a multiple location arrangement.

As shown in FIG. 2, the pouch feeder module 10 includes rollers 12 for feeding the pouches to the output 14 of the pouch feeder module 10. The means for feeding the pouches to the output 14 of the pouch feeder module 10 may consist of other methods as is known in the prior art. A robotics module 16 is shown to be coupled to the output 14 of the pouch feeder module 10. The robotics module 16 includes arms 18 for retreiving the pouches 20 from the output 14 of the pouch feeder module 10. The arms 18 are also used to stack the pouches in a container 22. The container 22 may contain approximately 100 to 500 pouches 20. The robotics module 16 feeds the containers 22 into an input stage 24 of a filling and sealing module 26. The filling and sealing module 26 includes rollers 28. or other means known in the prior art in order to arrange the pouches individually within the filling and sealing module 26 for filling and sealing of the pouches 20. The sealed pouches 20 are then advanced to the output stage 30. A transport system 32 is provided at the output stage 30 for receiving the sealed pouches 20. The sealed pouches 20 are advanced along the transport system 32 to the cartoning module 34 whereat the pouches 20 may be packed in boxes 36.

It can be seen that the robotics module 16 can be adapted to couple with a plurality of filling and sealing modules 26 such as is shown in FIG. 1. Further, the robotics module 16 can be arranged to retrieve the pouches from a plurality of pouch feeder modules 10. In addition, the system can be arranged to have a plurality of cartoning modules 34 coupled to the transport system 32.

During the operation of the system as shown in FIG. 1, the pouch feeder module 10 feeds pouches 20 to the output of the pouch feeder module 14. The arms 18 of the robotics module 16 retrieves the pouches 20 from the output 14 of the pouch feeder module 10 and stacks a plurality of pouches in the container 22. The container 22 is loaded into the input stage 24 of the filling and sealing module 26 whereupon the pouches 20 are removed from the container 22 and then filled and sealed with the desired product. The sealed pouches 20 exit the filling and sealing module 26 at the output stage 30 and are advanced along the transport system 32. Pouches are then further advanced to the cartoning module 34 whereat they are loaded and packaged into boxes 36.

The pouch feeder module 10 and a robotics module 16 can be located in a single location whereat the pouches are assembled into containers 22. The containers 22 can then be shipped to another location, either in an adjacent area of the same location or in a remote location, whereat the containers 22 are loaded by a further robotics module 16 into the filling and sealing modules 26. The further location would also include the transport system 32 and cartoning module 34 for packaging the sealed pouches in boxes 36 as described in the foregoing.

The foregoing described system eliminates unnecessary manpower for the operation of the system in comparison to prior art systems. The foregoing described system provides a decreased production time, and the waste of pouches 20 is reduced due to the proper alignment and sequencing of the pouches 20 by means of the robotics module 16.

I claim:

1. A system of filling and sealing polymeric pouches, comprising:

a robotics module for providing containers having a plurality of pouches;

a filling and sealing module for having an input stage for receiving the containers having a plurality of pouches and for removing the pouches from the containers, a filling stage for filling the pouches, a sealing stage for sealing the filled pouches, and an output stage;

a means of transport coupled to the output stage for transporting the pouches; and a cartoning module coupled to the transport means for receiving and packaging the pouches.

2. The system of claim 1, wherein the filling and sealing module includes a mechanical apparatus and automated suction cups for handling the pouches, and a pressurized air source for opening the pouches for filling.

3. The system of claim 1, wherein the robotics module includes means for coupling to a plurality of filling and sealing modules.

4. The system of claim 1, wherein the container contains 100–500 pouches.

5. The system of claim 1, wherein the robotics module includes means for positioning the pouches in an aligned manner.

6. The system of claim 5, wherein the positioning means includes at least one robotic arm.

7. The system of claim 5, wherein the positioning means aligns pouches in sequence to feed properly into each module.

8. The system of claim 1, wherein the container includes pouches with pre-formed spouts and the filling and sealing module includes means for heat sealing and means for cool sealing the pouches and means for aligning the pouches with the heat and cool sealing means.

9. A system of forming, filling and sealing polymeric pouches, comprising:

a pouch feeder module having a means for feeding module to the output of the pouch feeder;

a robotics module coupled to the output of the pouch feeder module, the robotics module having means for handling the pouches being fed to the output of the pouch feeder, the robotics module having means for loading a plurality of pouches into a container;

a filling and sealing module having an input stage for receiving the containers and for removing the pouches from the container, a filling stage for filling the pouches, a sealing stage for sealing the filled pouches, and an output stage;

a means for transport coupled to the output stage for transporting the pouches; and a cartoning module coupled to the transport means for receiving and packaging the pouches.

10. The system of claim 9, wherein the container contains 100–500 pouches.

11. The system of claim 9, wherein the robotics modules includes means for positioning the pouches in an aligned manner.

12. The system of claim 11, wherein the positioning means includes at least one robotic arm.

13. The system of claim 11, wherein the positioning means aligns pouches in sequence to feed properly into each module.

14. The system of claim 9, wherein the pouch feeder includes means for forming pouches.

15. The system of claim 14, wherein the pouch feeder includes means for pre-forming the spout of the pouch.

16. The system of claim 9, wherein the container includes pouches with pre-formed spouts and the filling and sealing module includes means for heat sealing and means for cool sealing the pouches and means for aligning the pouches with the heat and cool sealing means.

17. The system of claim 9, wherein the robotics module includes means for coupling to a plurality of pouch feeder modules.

18. The system of claim 9, wherein the filling and sealing module includes a mechanical apparatus and automated suction cups for handling the pouches, and a pressurized air source for opening the pouches for filling.

19. The system of claim 9, wherein the robotics module includes means for coupling to a plurality of filling and sealing modules.

20. The system of claim 9, wherein the transport means is coupled to a plurality of cartoning modules.

* * * * *